United States Patent [19]

Millerbernd

[11] 4,092,707

[45] May 30, 1978

[54] HIGH LEVEL LIGHT SUPPORTING AND LIGHT LOWERING MEANS

[76] Inventor: Paul A. Millerbernd, Winsted, Minn. 55395

[21] Appl. No.: 739,831

[22] Filed: Nov. 8, 1976

[51] Int. Cl.[2] ..... F21V 21/36; F21S 1/10

[52] U.S. Cl. ..... 362/391; 362/403; 362/431

[58] Field of Search ..... 240/64, 65, 67, 84, 240/85 A

[56] References Cited

U.S. PATENT DOCUMENTS

| | | | |
|---|---|---|---|
| 3,805,054 | 4/1974 | Wolf | 240/64 |
| 3,847,333 | 11/1974 | Zeller | 240/64 |
| 3,856,639 | 12/1974 | Rohn et al. | 240/64 |
| 3,911,267 | 10/1975 | Kiehn | 240/64 |

*Primary Examiner*—J D Miller
*Assistant Examiner*—Peter S. Wong
*Attorney, Agent, or Firm*—Merchant, Gould, Smith, Edell, Welter & Schmidt

[57] ABSTRACT

A light supporting frame and a carriage therefor mounted for vertical movements on a hollow tower having an upwardly tapering hollow base which contains a power operated winding drum on which is wound a pair of frame and carriage supporting cables. A transverse support arm extends in opposite directions from the top of the tower. Cooperating latch and strike elements releasably lock the light supporting frame to the transverse support arm, and latch releasing devices are carried by the frame and carriage. Tower engaging stabilizers on the frame and carriage hold the same against lateral movement relative to the tower. The winding drum is provided with an automatic brake to stop rotation of the winding drum when power is cut off therefrom.

9 Claims, 20 Drawing Figures

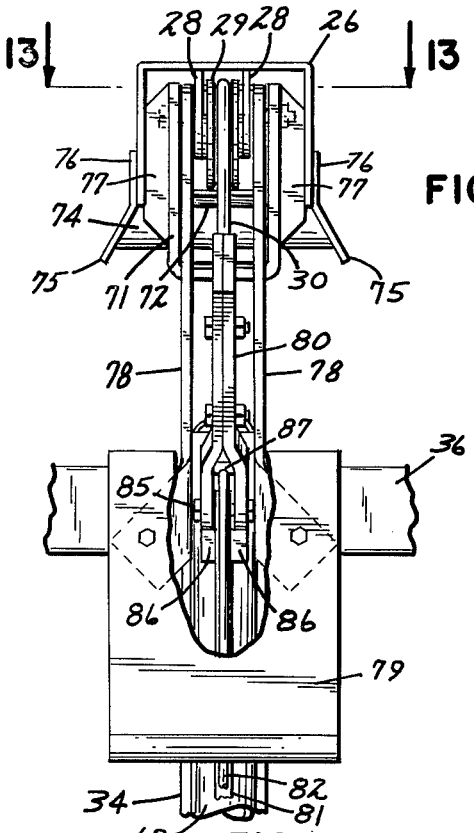
FIG. 12
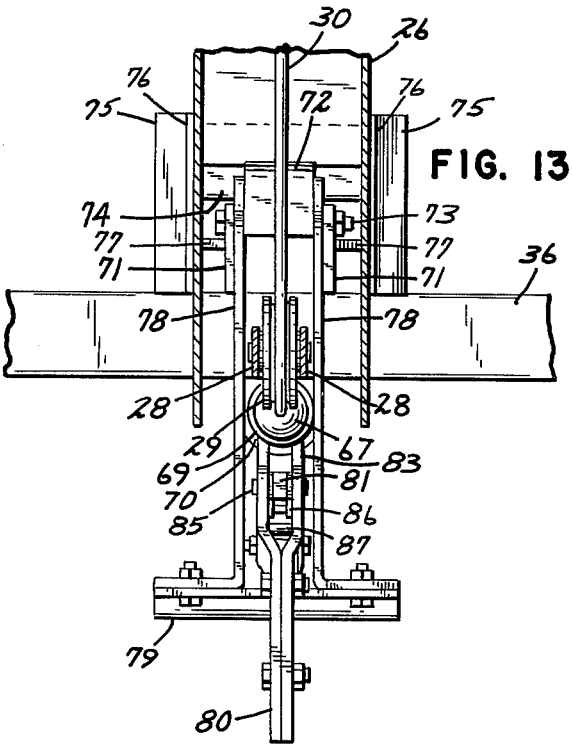
FIG. 13
FIG. 14
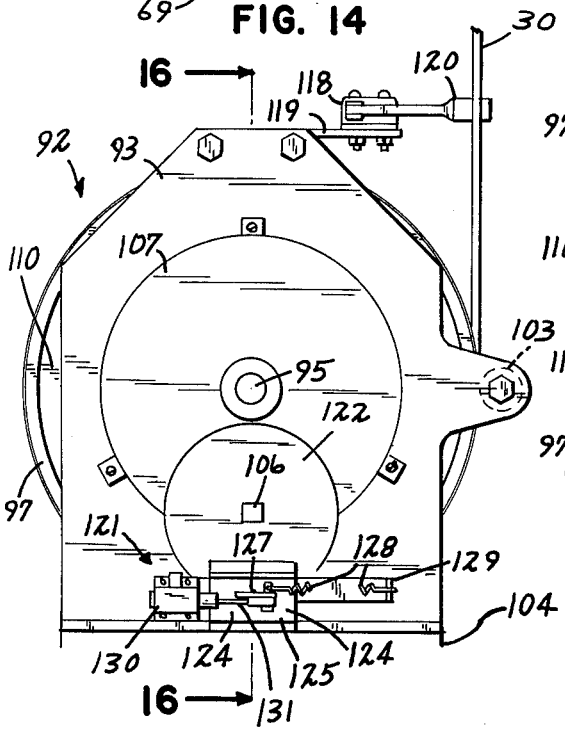
FIG. 15
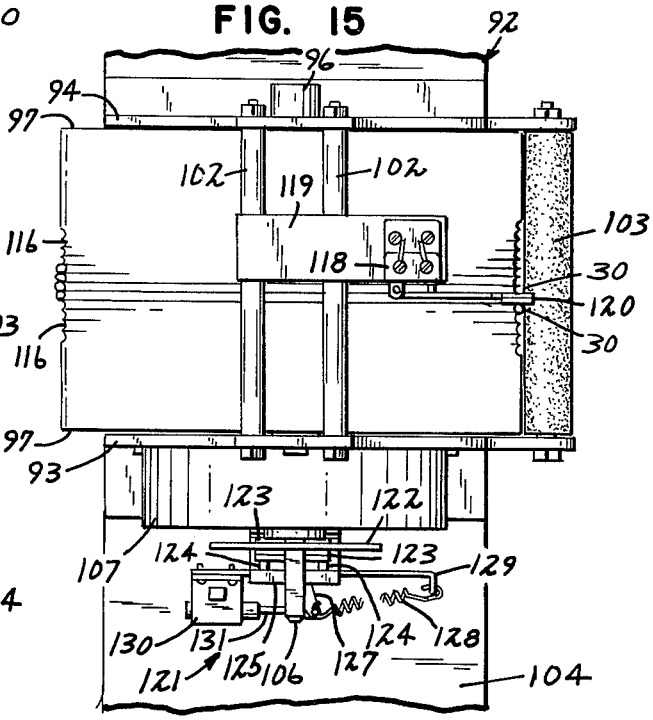

HIGH LEVEL LIGHT SUPPORTING AND LIGHT LOWERING MEANS

BACKGROUND OF THE INVENTION

This invention is in the nature of an improvement over the structure disclosed in my prior U.S. Pat. No. 3,670,159. In said prior patent, a light supporting frame is raised and lowered by means of a cable supported carriage, and automatically locked in place at the top of the tower or pole. To release the frame from its locked position, the carriage must be lowered to substantially ground level and latch releasing mechanism manually set, after which the carriage is again raised so that the latch releasing mechanism may unlock the frame for lowering movements to the ground where the lights may be serviced or replaced. Further, my earlier apparatus, like one disclosed in U.S. Pat. No. 3,856,639, issued to Rohn, et al., uses at least three cables for raising and lowering a light supporting unit, these being adjustably secured at inner ends, by means of a coupling device, to a single hoisting cable wound on a drum at the base of the pole or tower. Such coupling devices occupy needed space in a tower, and may rub against electrical conductors within the tower, creating a hazard.

SUMMARY OF THE INVENTION

This invention involves a vertical tower and support means at the upper end of the tower and having opposite portions laterally outwardly spaced from said tower. A light mounting frame is movable between a low level near the ground and a high level at the support means, and latch means is operative to releasably lock the frame to said support means. A carriage underlies said frame and has frame engaging elements for supporting the frame and for holding the frame and carriage against movement relative to each other about the axis of the tower. Elevating means is provided for raising and lowering the carriage between substantially ground level and an upper position near the top of said tower and independently of said frame when the frame is latched to said support means; and automatic latch operating means on the carriage and frame is operative, responsive to predetermined relative vertical movements between the carriage and frame, to release said latch means, whereby the frame may be lowered toward ground level with said carriage.

BRIEF DESCRIPTION OF THE DRAWINGS

FIG. 2 is an enlarged view in top plan, as seen from the line 2—2 of FIG. 1;

FIG. 3 is an enlarged horizontal section, taken on the line 3—3 of FIG. 1, some parts being broken away;

FIG. 4 is a further enlarged fragmentary view corresponding to a portion of FIG. 3;

FIG. 5 is an enlarged fragmentary section taken on the line 5—5 of FIG. 1;

FIG. 12 is a fragmentary view in side elevation as seen from the line 12—12 of FIG. 1, some parts being broken away;

FIG. 13 is a view partly in top plan and partly in horizontal section, taken on the line 13—13 of FIG. 12;

FIG. 14, is a view in side elevation of cable winding mechanism of this invention;

FIG. 15 is a view in top plan of the cable winding mechanism of FIG. 14;

DETAILED DESCRIPTION OF THE PREFERRED EMBODIMENT

Figure 1:
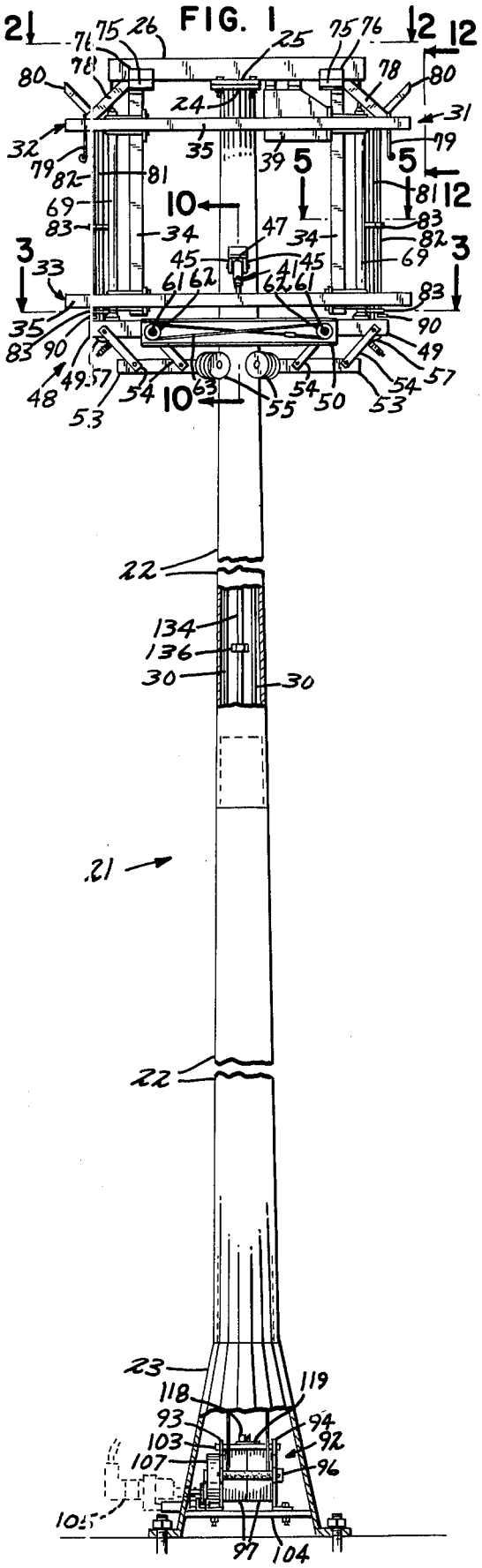
FIG. 1 is a view in side elevation of a high level light supporting and light lowering means produced in accordance with this invention, some parts being broken away and some parts being shown in section.

A vertically extending light pole or tower, indicated generally at 21, includes a plurality of hollow tower sections 22 suitably connected in end-to-end relationship, the lowermost one thereof being mounted on an upwardly tapering hollow base 23 that is bolted or otherwise rigidly secured to a suitable foundation in the ground. At its upper end, the tower 21 is provided with a radially outwardly projecting collar 24 to which is bolted or otherwise rigidly secured a pair of mounting flanges 25 that project laterally outwardly from the intermediate portion of a horizontally disposed transverse support member 26. The support member 26 is in the nature of an elongated downwardly opening channel, the same having mounted therein pairs of inner and outer brackets 27 and 28 respectively in which are journaled pulleys 29 for entrainment thereover of respective flexible cables 30 that extend downwardly through the interior of the tower 21 to the base thereof.

Figures 8, 9, 10, 11:
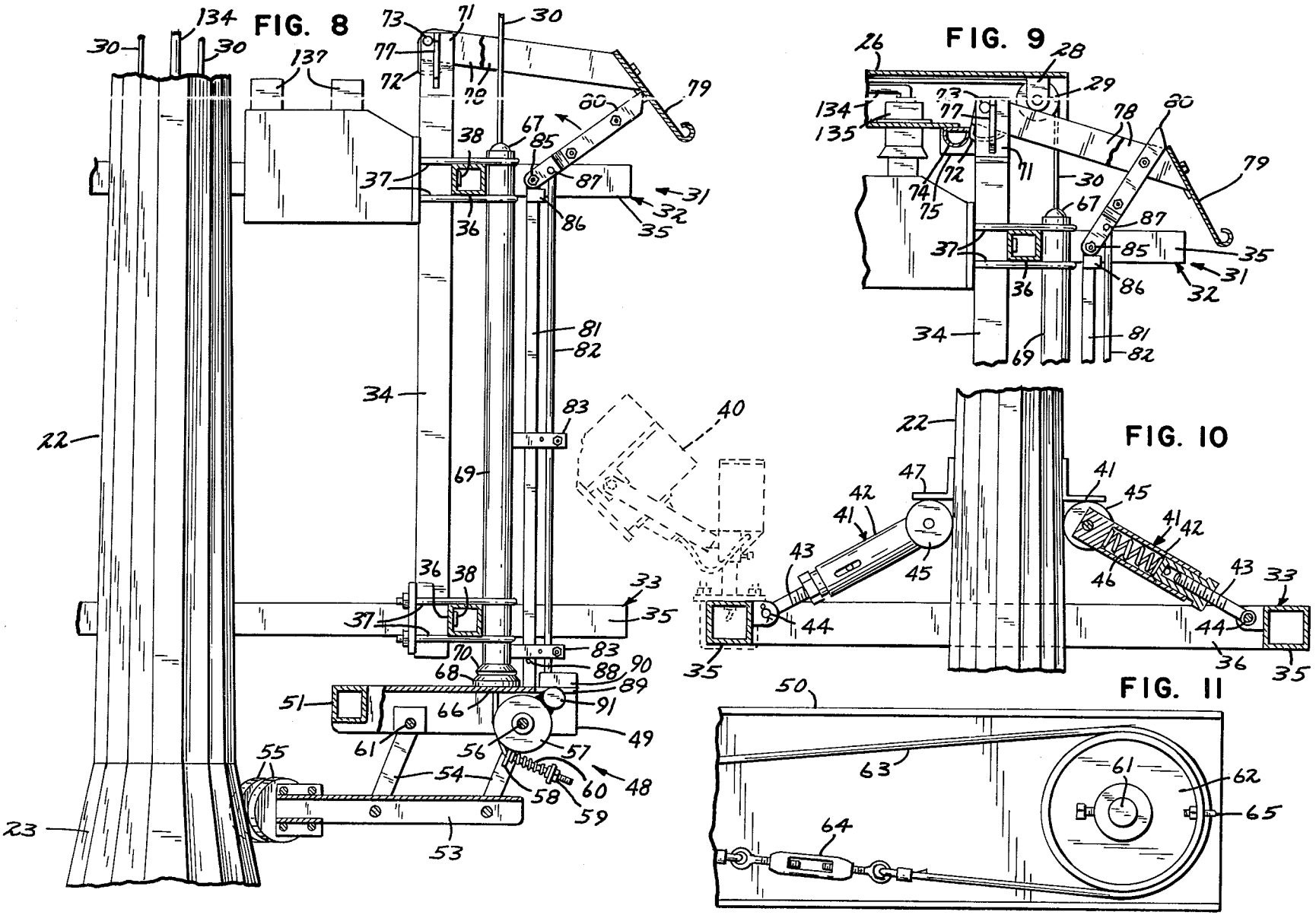
FIG. 8 is a view corresponding generally to FIGS. 6 and 7 but showing the light supporting frame and carriage of this invention in a lowered position relative to the light supporting tower.
FIG. 9 is a view corresponding to a portion of FIGS. 6 and 7 but showing a different position of some of the parts.
FIG. 10 is an enlarged fragmentary section taken generally on the line 10—10 of FIG. 1.
FIG. 11 is an enlarged fragmentary detail in side elevation corresponding to a portion of FIG. 1.

A generally rectangular light supporting frame 31 encompasses the tower 21 and comprises vertically spaced upper and lower frame sections 32 and 33 respectively connected together by a pair of laterally spaced vertical frame members 34. The frame sections 32 and 33 each comprise laterally spaced longitudinal side frame members 35 and cross frame members 36 welded at their opposite ends to the side frame members 35, the vertical frame members 34 being secured to intermediate portions of the cross frame members 56 by elongated U-bolts 37 and hollow insulating bushings 38, see particularly FIG. 6. As therein shown, a pair of the U-bolts 37 are also used to mount a junction box 39 to one of the cross frame members 36. The several frame members 34–36 are preferably made of cross sectionally rectangular metallic tubing, and are adapted to have mounted thereon light fixtures or any other desired equipment, FIG. 10 showing an illuminating fixture 40 mounted on one of the side frame members 35.

Means for holding the frame against lateral movement relative to the tower 21, in one vertical plane, comprises a pair of generally opposed stabilizer arms 41, each including telescoping inner and outer arm sections 42 and 43 respectively, the latter being pivotally secured to respective ones of the side frame members 35, as indicated at 44. Tower engaging rollers 45 are journaled to the inner ends of the stabilizer arms 41, as shown in FIG. 10, and coil compression springs 46 within the inner arm sections 42 yieldingly urge the arm sections 42 and 43 in a direction to extend the lengths of the stabilizer arms 41. Near its upper end, the tower 21 is provided with a pair of stop flanges 47 that engage the rollers 45 and cooperate with the springs 46 to yieldingly limit upward movement of the frame 31.

Means for supporting the frame 31 for movements between a lowered position adjacent the base 23 and a raised operative position adjacent the transverse support member 26 comprises a carriage indicated generally at 48. The carriage 48 is generally horizontally disposed and is elongated in a direction parallel to the longitudinal dimension of the frame 31, the carriage 48 including a pair of aligned longitudinally spaced downwardly opening channel portions 49 that extend in opposite directions radially of the tower 21, a laterally outwardly opening channel member 50 disposed in laterally spaced parallel relationship to the members 49, and a pair of cross members 51 welded at their opposite ends to the inner ends of respective members 49 and to longitudinally spaced portions of the channel member 50. The members 50 and 51 are braced by gussets or the like 52.

The carriage 48 is provided with a pair of stabilizer arms 53 each of which partially underlies a different one of the channel members 49, being connected thereto by laterally spaced pairs of parallel links 54 pivotally connected at their opposite ends to respective ones of the members 49 and bars 53. At their inner ends, the stabilizer arms 53 are provided with sets of guide rollers 55 that bear generally radially against the outer surface of the tower 21 and roll thereon during upward and downward movements of the carriage 48 with respect to the tower 21. The stabilizer arms 53 and their respective rollers 55 hold the carriage 48 against lateral movements in a vertical plane generally normal to the plane in which the frame 31 is stabilized by the stabilizer arms 41. The longitudinally outermost pair of links 54 are pivotally secured to the outer end portions of their respective channel members 49 by pivot shafts 56 to which are keyed or otherwise rigidly secured pulleys 57. Each pulley 57 is provided with a radially outwardly projecting lug 58 having an opening therethrough for reception of the outer end portion of a respective one of the cables 30. The outer ends of the cables 30 are yieldingly anchored to the lugs 58 by washer equipped adjustment nuts 59 screw threaded on the threaded outer ends of the cables 30 and coil compression springs 60 interposed between the washer equipped nuts 59 and the lugs 58.

For the purpose of centering the carriage 48 laterally with respect to the tower 21, the upper ends of the inner links 54 are rigidly secured to shafts 61 journaled in the channel members 49 and having opposite ends journaled in the opposite end portions of the channel member 50. A pair of pulleys 62 are fixed on the outer ends of the shafts 61 and have entrained thereover a flexible cable 63, the flights thereof crossing intermediate the pulleys 62, as shown in FIG. 1. The opposite ends of the cable are secured to a turnbuckle 64 and the cable 63 is secured to the pulleys 62 by means of anchoring U-bolts 65, see FIGS. 3 and 11. With this arrangement, while the stabilizers or arms 53 are free to move inwardly and outwardly with respect to the axis of the tower, the tower remains centrally disposed in a horizontal direction relative to the carriage 48 in all positions of the carriage longitudinally of the tower 21.

Figure 6:
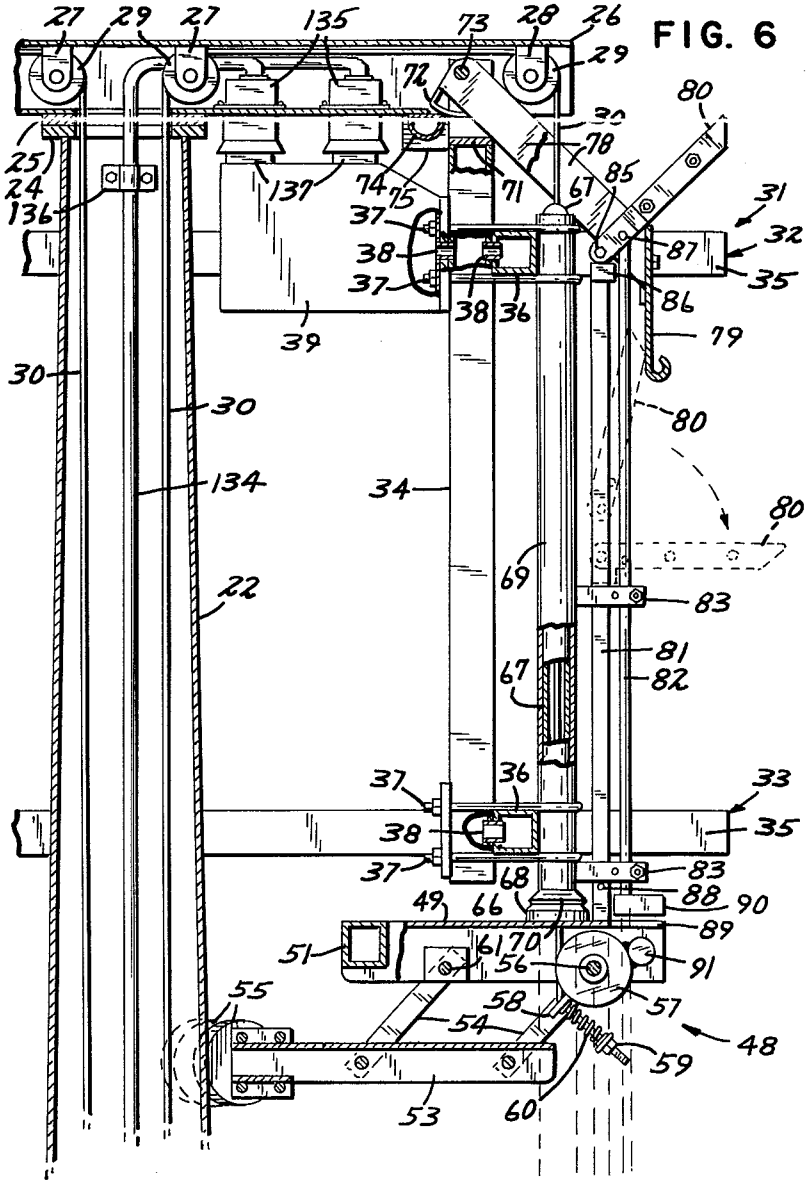
FIG. 6 is an enlarged fragmentary section taken generally on the line 6—6 of FIG. 2.

Each pulley 57 is so disposed relative to one of the pulleys 29 journaled in the outer brackets 28, that the upper or outer end portions of the cables 30 are disposed in straight, vertical lines between the outer pulleys 29 and their respective pulleys 57, as shown in FIG. 6. Each cable 30 passes upwardly through an opening 66 in a respective one of the carriage members 49, and through a vertically elongated tubular member 67 having a diametrically enlarged tapered lowered end portion 68 that is rigidly secured to its respective channel member 49. Each tubular member 67 has a tapered upper end for easy telescopic sliding reception in a respective one of a pair of vertically extended guide tubes 69 that are anchored to the frame cross members 36 by the elongated U-bolts 37. At their lower ends, the guide tubes 69 are provided with downwardly and outwardly flaring flanges 70 that are adapted to have seating engagement with the tapered portions 68, so as to hold the carriage 48 and frame 31 against relative rotation therebetween about the axis of the tower 21. When the carriage 48 is lowered toward the lower end of the tower 21, the members 67 move out of telescopic engagement with the guide tubes 69. Subsequently, when the carriage 48 is raised toward the frame 31, the cables 30 guide the tapered upper ends of the tubular members 67 into the flanged lower ends of the guide tubes 69 so that smooth telescopic engagement is achieved.

At their upper ends, each of the vertical frame members 34 has mounted thereon one of a pair of U-shaped brackets 71. A pair of latch members 72 are mounted in the brackets 71 by means of pivot pins 73, one each of the latch members 72 and pivot pins 73 being shown. The latch members 72 are adapted to have latching engagement with cooperating strike elements 74 that are rigidly mounted between angularly outwardly and downwardly projecting flanges 75 of brackets 76 welded or otherwise rigidly secured to the opposite sides of the transverse support member 26. The U-shaped brackets 71 are provided with outwardly projecting flanges 77 which cooperate with the flanges 75 to guide the latch members 72 upwardly into the interior of the transverse support member 26. Each latch member 72 is provided with a pair of laterally spaced latch arms 78 that extend outwardly therefrom and which, at their outer ends, are secured to signal plates 79.

Each of the latch members 72 is operatively associated with a different one of a pair of latch operating means each comprising an actuating lever 80 and a pair of elongated vertical inner and outer push rods 81 and 82 respectively. The push rods 81 and 82 are disposed in laterally outwardly spaced relationship to respective ones of the guide tubes 69, and are mounted for vertical reciprocatory movements relative to the frame 31 by means of vertically spaced guide brackets 83 projecting laterally outwardly from the guide tubes 69. The latch operating levers 80 have bifurcated inner ends pivotally secured, as at 85, to the upper ends of the inner push rods 81. Lugs 86 on the push rods 81 engage the levers 85 to limit downward pivotal movement of the levers 85. Further, the inner bifurcated end portions of the latch operating levers 80 are pivotally connected to the upper ends of their respective outer push rods 82, as indicated at 87, the latch operating levers being movable between the latch arms 78 of their respective latches 72. The lower ends of the push rods 81 are adapted to rest upon the channel members 49 when the carriage 48 is disposed in supporting relationship to the frame 31. Adjacent its lower end, each push rod 81 is provided with a cross pin or the like 88 that is adapted to engage the lowermost one of the brackets 83 to limit upward movement of the push rod 81 relative to the frame 31. At their outer ends, the channel members 49 are provided with notches 89 for reception of enlarged feet 90 at the lower ends of the outer push rods 82, these being adapted to engage bosses 91 projecting radially outwardly from respective ones of the pulleys 57. When the carriage 48 is moved downwardly away from the frame 31, downward movement of the push rods 81 and 82 is limited by engagement of the heads 86 with the uppermost ones of the guide brackets 83, as shown by dotted lines in FIG. 6.

The cables 30 have their inner ends connected to a winch 92 mounted in the base 23 of the tower 21, the winch 92 comprising a pair of spaced parallel end plates 93 and 94, a shaft 95 journaled in bearings 96 in the end plates 93 and 94, and a pair of axially aligned winding drum sections 97 disposed between the end plates 93 and 94 and having radial spokes 98, the inner ends of which are provided with bearings 99 by means of which the drum sections 97 are journaled on the shaft 95. The drum sections 97 are formed to provide flanges 100 that are bolted together by machine screws or the like 101. The end plates 93 and 94 are securely held together in axially spaced relationship by tie rod equipped tubular spacers 102 and 103 and by being rigidly secured to a mounting platform 104 in the base 23.

Figure 17:
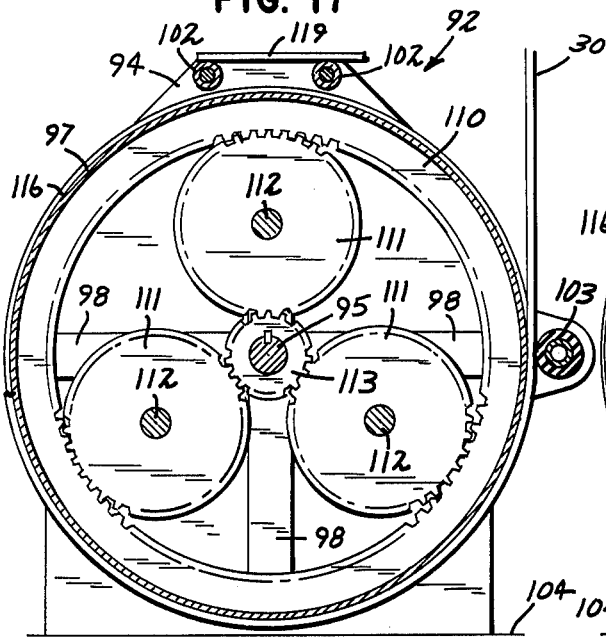
FIGS. 17 and 18 are transverse sections taken on the lines 17—17 and 18—18 respectively of FIG. 16.
Figure 18:
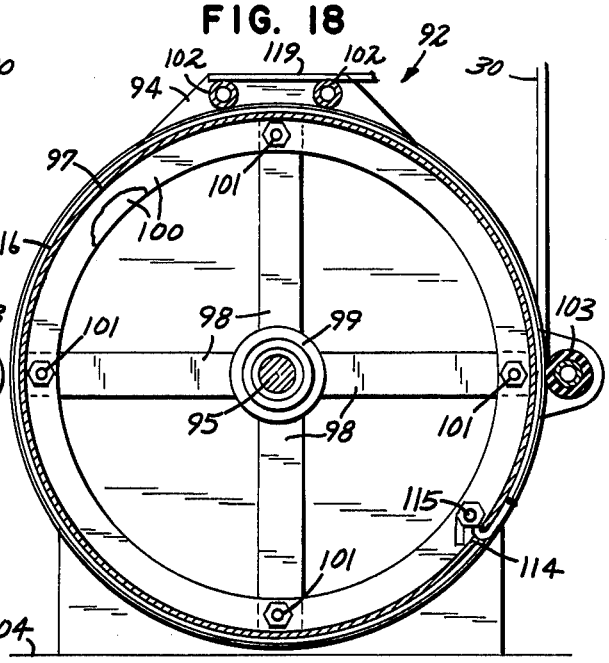

Rotary movement is imparted to the winding drum sections 97 by a motor 105, the drive shaft of which is adapted to drivingly engage an input shaft 106 that is journaled in suitable bearings in the end plate 93 and a cover member 107 secured to the end plate 93. Within the cover member, a drive pinion 108 is keyed to the input shaft 106 and meshes with a gear 109 keyed to the shaft 95. One of the drum sections 97, disposed adjacent the end plate 93, is provided with an internal ring gear 110 that has meshing engagement with a plurality of circumferentially spaced planet gears 111 journaled on stubshafts 112 that are mounted in the end plate 93. A sun gear or pinion 113 is keyed to the shaft 95 and has meshing engagement with the planet gears 111, see particularly FIG. 17.

Figure 16:
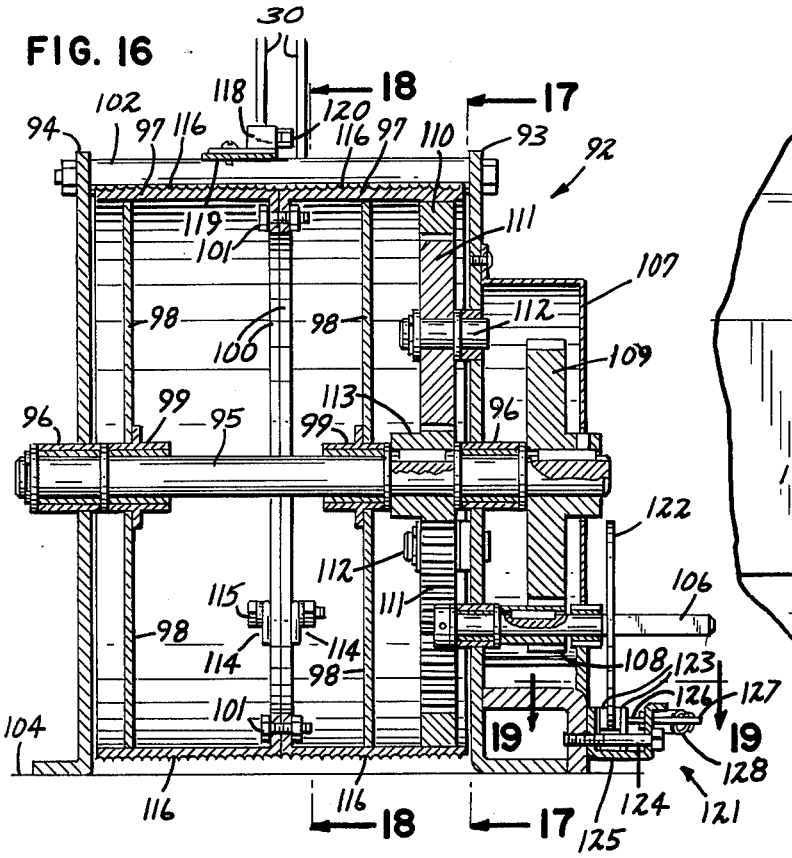
FIG. 16 is an enlarged axial section taken on the line 16—16 of FIG. 14.
Figure 19:
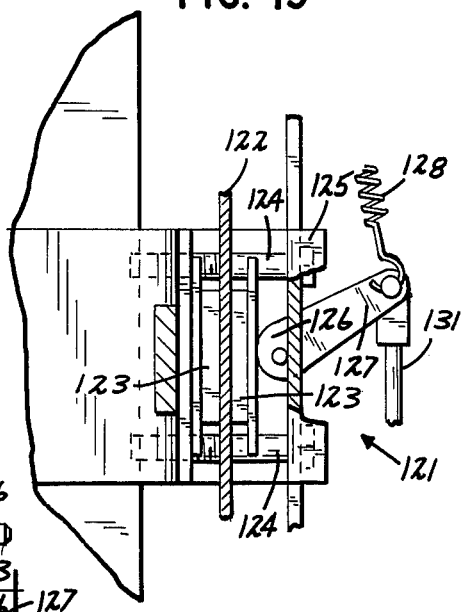
FIG. 19 is an enlarged fragmentary section taken on the horizontal line 19—19 of FIG. 16.

With reference to FIG. 16, it will be seen that the extreme inner ends of the cables 30 extend through openings 114 in respective ones of the drum sections 97 adjacent the flanges 100 thereof, and are rigidly secured by suitable means, such as an anchoring bolt 115. The outer peripheral surface of each drum section 97 is formed to provide a helical groove 116 for reception of the cables 30. The drum sections 97 are of such diameter and axial length that a single layer of hoisting cable 30 thereon is more than sufficient to permit lowering of the carriage 48 to substantially ground level. With this arrangement, the hoisting cables 30 follow their respective grooves 116 and do not pile up on their respective drum sections. Thus, without piling up of the cable on either drum section 97, the carriage 48 and frame 31 are maintained in a level condition at all times.

The hoisting motor 105 is controlled by a manually operated switch 117, and a lower limit switch 118, the former of which may be mounted on the hoisting motor 105 or closely spaced therefrom, the latter being mounted on the winch 92 by means of a bracket 119, see FIGS. 14–16. The switch 118 is operated by means of a sensing element 120 that is positioned to be moved by one of the hoisting cables 30 when the carriage 48 is lowered to substantially ground level, to de-energize the motor 105 before any slack occurs in the hoisting cables 30. The motor 105 is reversible, the switch 117 being of a commercially available reversing switch for the motor 105.

Figure 20:
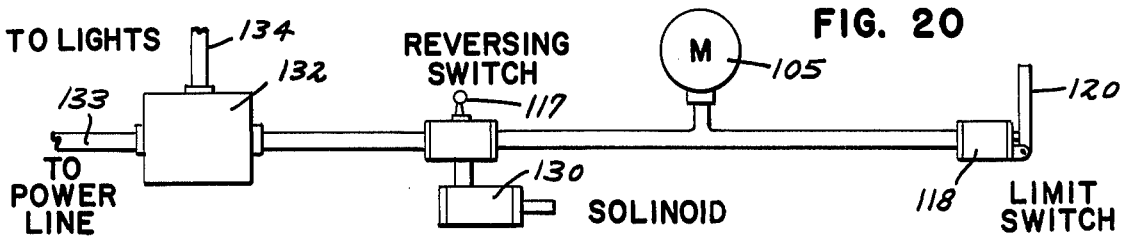
FIG. 20 is a schematic diagram.

Control of the winch is further had by a disc brake mechanism 121 comprising a brake disc 122 mounted on the shaft 106, and a pair of brake pads 123 carried by bolts 124 mounted on a bracket 125. The pads 123 are moved into braking engagement with opposite sides of the disc 122 by a cam 126 pivotally mounted in the bracket 125 and having an upwardly extended arm 127 to the outer end of which is connected a coil tension spring 128. As shown in FIGS. 14 and 15, the outer end of the spring 128 is connected to an extended portion 129 of the bracket 125. A solenoid 130 is mounted on the bracket 125 and is operatively connected to the cam arm 127 by means of a link 131 for the purpose of releasing the brake mechanism 121 against bias of the spring 128 when it is desired to raise or lower the carriage 48. The solenoid 130 is operatively connected to the switch 117 so that, when the motor 105 is energized, the solenoid 130 is also energized. Conversely, when the motor 105 is de-energized, the solenoid 130 is also de-energized simultaneously therewith, so that the spring 128 sets the brake mechanism 121 immediately upon de-energization of the motor 105. As shown diagramatically in FIG. 20, power is supplied to the motor 105 from a junction box 132 that may be assumed to be mounted in the hollow base 23 and connected to a source of electrical potential, such as a power line, through a power cable 133.

Power for illuminating the lamps of the light fixtures 49 is obtained from the junction box 132 through lighting cables 134 that extend upwardly from the junction box 132 through the interior of the tower 21 to a pair of connector sockets 135 mounted in the transverse support 26. The cables 134 are supported along the inner surface of the tower 21 by mounting clips or light fasteners 136. The junction box 39 is provided with a pair of connector plugs 137 that are received in the sockets 135. Although not shown, it may be assumed that electrical conductors are connected to the plugs 137 and extend through given ones of the frame members 34–36 and through bushings 38 to the illuminating fixture 40. Also, although not shown, it may be assumed that the junction box 132 within the base 23 is provided with suitable switching mechanism for supplying electrical current to the illuminating fixtures 40. The connector sockets 135 and plugs 137 are conventional in structure, and detailed description thereof is omitted, in the interest of brevity.

OPERATION

When the carriage 48, with the frame 31 resting thereon and the tapered lower end portions 68 of the tubular members 67 engaging the flanges 70 of the guide tubes 69, are in their lowered position shown in FIG. 8, the lower ends of the inner push rods 81 are in engagement with the top surfaces of their respective channel members 49, and laterally outward movement of the stabilizer arms 53, caused by engagement of the rollers 55 with the base 23 causes the pulleys 57 to rotate in directions to effect engagement between the bosses 91 and their respective feet 90 to raise the outer push rods 82. This raising of the outer push rods 82 imparts upward swinging movements to the latch operating levers 80 so that they engage their respective signal plates 79 to impart upward swinging movements to the latch arms 78. During said upward swinging movement of the latch operating levers 80, the levers reach a point shown in FIG. 8, at which point the weight of the latch arms 78 and signal plates 79 causes the levers 80 to be cammed upwardly as indicated by an arrow in FIG. 8, permitting the latch arms 78 to swing downwardly to their positions of FIGS. 1 and 6, at which point the latch operating levers 80 swing downwardly toward engagement with the upward edges of the signal plates 79.

Energization of the motor 105 causes the carriage 48 and frame 31 to be raised until the laterally inner sides of the latch members 72 engage the curved surfaces of the strike elements 74, imparting upward swinging movements to the latch arms 78, as shown in FIG. 9. As the frame 31 continues to move upwardly, the latch members 72 move above the level of the tops of the strike elements 74, whereupon the latch arms 78 and latch operating levers 80 swing to their positions of FIG. 6. When the operator sees the signal plates 79 swing down to their vertical positions, he de-energizes the motor 105 to cease further upward movement of the carriage 48 and frame 31. When the latch arms 78 are moved to their latched positions of FIG. 6, the motor 105 may be run in a reverse direction sufficiently to ease tension on the cables 30, so that the weight of the frame 31 is carried by the strikes 74 and latch arms 78, the weight of the carriage 48 only being carried by the cables 30. It will here be noted that the stabilizer arms 41, being compressed between the frame members 35 and the stop flanges 47, yieldingly hold the frame 31 and carriage 48 against lateral movements in one vertical plane, relative to the tower 21. The stabilizer arms 53, being yieldingly urged toward engagement of the rollers 55 with the tower 21 by the springs 60, yieldingly hold the carriage 48 and frame 31 against lateral movements in a vertical plane normal to the above mentioned vertical plane. Thus, the frame 31 and carriage 48 are effectively held against lateral movement in any direction, which may be caused by the winds, when the frame and carriage are in their uppermost positions above-described.

Figure 7:
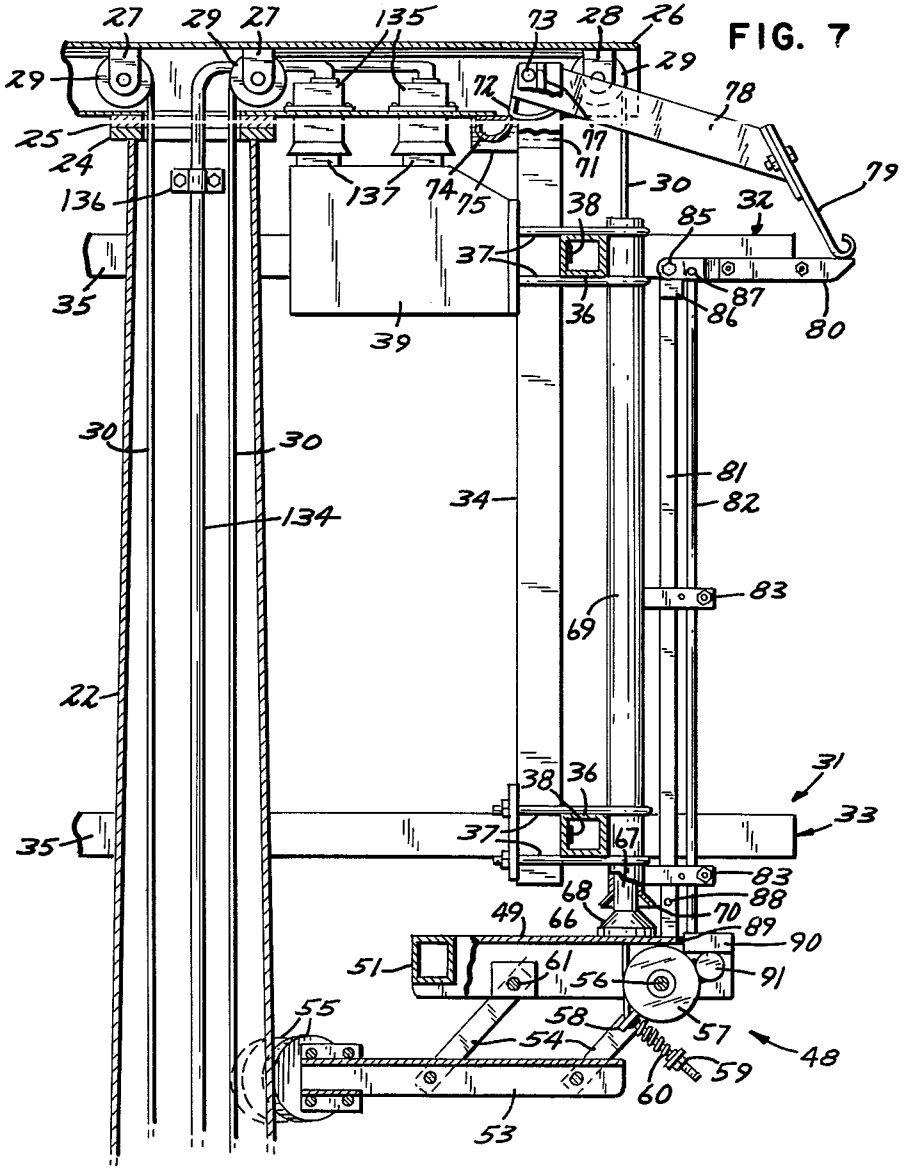
FIG. 7 is a view similar to FIG. 6 but showing a different position of some of the parts.

When it is desired to lower the frame 31 for changing the lamps or otherwise servicing the same, the motor 105 is operated to lower the carriage from its position of FIGS. 1 and 6 a distance sufficiently to bring the latch operating levers 80 below the lower edges of the signal plates 79, whereupon the latch operating levers 80 swing downwardly to a horizontal position shown by dotted lines in FIG. 6. The motor 105 is reversed to cause the carriage 48 to be raised so that the horizontally disposed latch operating levers 80 engage the lower edges of their respective signal plates 79 and swing the same with their latch arms 78 upwardly until the latches 72 become disengaged from their respective strike elements 74, as shown in FIG. 7. It will be noted with reference to FIG. 7, that the feet 90 of the outer push rods 82 descend into engagement with their respective bosses 91, so that the latch operating levers 80 do not swing downwardly further than a horizontal position. The lugs 86 also prevent further downward swinging movement of the latch operating levers 80. It will be further noted that, when the latches 72 are released from engagement with their respective strike elements 74, the tapered lower end portions 68 of the tubular members 67 are disposed in closely spaced relationship to the flanges 70 of the guide tubes 69, so that the frame 31 descends a very short distance to be supported by the carriage 48. The motor 105 is again reversed to permit the carriage 48 and frame 31 to descend to their lowered position just above ground level for service or repair. As above-described, when the carriage and frame reach their lowered positions, rotation of the pulleys 57 cause the bosses 91 thereon to raise the upper push rods 82 and swing the latch operating levers 80 upwardly to resume their positions of FIG. 8 and thereafter their positions of FIGS. 1 and 6.

If for any reason it is desired to lower the carriage 48 to its lowered position independently of the frame 31, this may be done without unlatching the frame 31 in the manner abovedescribed.

While I have shown and described a commercial embodiment of my high level light support and light lowering means, it will be understood that the same is capable of modification without departure from the spirit and scope of the invention, as defined in the claims.

What is claimed is:

1. High level light supporting and light lowering means comprising:

(a) a vertical tower;

(b) support means at the upper end of said tower and having opposite portions laterally outwardly spaced from said tower;

(c) a light mounting frame movable between substantially ground level and said support means;

(d) latch means for releasably locking said frame to said support means;

(e) a carriage underlying said frame and vertically movable independently of said frame, said carriage having frame engaging portions for supporting said frame and for holding said frame and carriage against pivotal movement relative to each other about the axis of said tower;

(f) elevating means for raising and lowering said carriage between substantially ground level and an upper position near the top of said tower and independently of said frame when said frame is latched to said support means;

(g) and automatic latch-operating means on said carriage and said frame operative responsive to predetermined relative vertical movements between said carriage and frame to release said latch means, whereby said frame may be lowered toward ground level with said carriage.

2. The apparatus defined in claim 1 in which said light mounting frame comprises spaced upper and lower generally horizontal frame sections and a pair of laterally spaced vertical guide tubes extending between said sections, said carriage including a pair of elongated tubular members projecting upwardly therefrom and each disposed to be telescopically received in a different one of said guide tubes, said elevating means including a pair of cables each having one end portion extending longitudinally through a different one of said tubular members, further including means operatively connecting said cable end portions to said carriage.

3. The apparatus defined in claim 1 in which said elevating means includes a pair of cables extending longitudinally within said tower and each within an opposite one of said opposite portions of the support means, said cables having outer end portions extending downwardly from said opposite support means portions, further including means operatively connecting said outer end portions of the cable to said carriage and comprising a pair of anchoring members connected to spaced portions of said carriage for limited movement relative to said carriage, said anchoring members having portions cooperating with other portions on said frame to provide said latch operating means.

4. The apparatus defined in claim 3 in which said tower includes an upwardly tapering base portion; further including a pair of opposed stabilizer and centering assemblies on said carriage, each having an inner portion engaging an opposite side of said tower, said assemblies each being connected to a different one of said anchoring members to move the same in a given direction responsive to engagement of said assemblies with said base portion.

5. The apparatus defined in claim 3 in which said latch means comprises a pair of strike members each mounted on an opposite portion of said support means, and a cooperating pair of latch arms pivotally mounted on said frame on generally horizontal axes, said latch operating means comprising a pair of latch operating assemblies one for each latch arm and each including laterally spaced generally vertical first and second push rods mounted on said frame for independent vertical movements, and an actuating lever pivotally connected at spaced portions thereof to the upper ends of its respective push rods and operatively engaging a respective one of said latch arms, the lower end of said push rods engaging respective ones of said carriage and cable anchoring members.

6. The apparatus defined in claim 5 in which said tower includes an upwardly tapering base portion, further including tower engaging movable elements on said carriage operatively connected to said cable anchoring elements and responsive to engagement with said base portion, when said carriage is lowered to a position closely above ground level, to move said cable anchoring members in directions to impart upward movement to said second push rods.

7. The apparatus defined in claim 5 in which each actuating lever has an inner end pivotally secured to its respective first push rod, each actuating lever being pivotally secured to its respective second rod in closely spaced relation to said inner end, further including signal plates on each of said latch arms adapted to have camming engagement with the outer ends of respective ones of said actuating levers to enable movement of the latch arms downwardly beyond said actuating levers to their latching positions when said second push rods are moved upwardly by said cable anchoring members.

8. The apparatus defined in claim 2 in which one of said horizontal frame sections includes laterally spaced side frame members, and in further combination with a pair of generally opposed stabilizer arms each having an outer end pivotally connected to a different one of said side frame members, and roller means on the inner ends of said stabilizer arms engaging opposite sides of said tower to restrain said frame against lateral movement in one vertical plane, said stabilizer arms each comprising telescoping inner and outer arm sections axially movable relative to each other to longitudinally expand and contract said arms.

9. The apparatus defined in claim 1 in which said tower is hollow, having an enlarged hollow base, said elevating means comprising:

(a) a winding drum mounted within said base and having a pair of helical cable-receiving grooves pitched in opposite directions from the opposite ends of the drum to the axial center thereof;

(b) a pair of cables each wound in a different one of said grooves, said cables extending upwardly through said tower;

(c) said support means including a transverse support member at the upper end of said tower and inner and outer pulleys journaled in said support member at the upper end of said tower and adjacent to the opposite ends of said support member, respectively, said cables being entrained over respective ones of said inner and outer pulleys;

(d) means connecting the outer ends of said cables to said carriage;

(e) power operated means for imparting rotation to said winding drum in directions to raise and lower said carriage;

(f) control means for said power operated means including a sensing element adjacent said winding drum and engaged by one of said cables and moved thereby in a direction to de-energize said power operated means when said carriage reaches a predetermined low level above the ground;

(g) braking means for said winding drum;

(h) and actuator means for setting said brake means to stop rotation of said winding drum;

(i) said control means including mechanism for rendering said brake actuator means ineffective only during energization of said power operated means.

* * * * *